US007926262B2

(12) United States Patent
Cox et al.

(10) Patent No.: US 7,926,262 B2
(45) Date of Patent: Apr. 19, 2011

(54) REGENERATION DEVICE PURGED WITH COMBUSTION AIR FLOW

(75) Inventors: Glenn B. Cox, Peoria, IL (US); Thomas R. McClure, Washington, IL (US); Robert L. Miller, Dunlap, IL (US); Stephen M. Wiley, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 974 days.

(21) Appl. No.: 11/806,355

(22) Filed: May 31, 2007

(65) Prior Publication Data

US 2008/0295502 A1 Dec. 4, 2008

(51) Int. Cl.
*F01N 3/00* (2006.01)
*F01N 3/10* (2006.01)

(52) U.S. Cl. ..... 60/295; 60/286; 60/303

(58) Field of Classification Search ..... 60/273, 60/286, 295, 303, 311, 293
See application file for complete search history.

(56) References Cited

U.S. PATENT DOCUMENTS

| | | | | |
|---|---|---|---|---|
| 3,408,994 | A | 11/1968 | Kraus | |
| 3,904,347 | A * | 9/1975 | Rokudo et al. | 431/1 |
| 4,121,544 | A | 10/1978 | May | |
| 4,191,136 | A | 3/1980 | Matsumoto | |
| 4,280,459 | A | 7/1981 | Nakanishi et al. | |
| 4,502,278 | A * | 3/1985 | Stark | 60/303 |
| 4,547,147 | A * | 10/1985 | Suzuki et al. | 431/265 |
| 4,557,108 | A * | 12/1985 | Torimoto | 60/286 |
| 4,576,617 | A * | 3/1986 | Renevot | 95/279 |
| 4,651,524 | A | 3/1987 | Brighton | |
| 4,912,920 | A * | 4/1990 | Hirabayashi | 60/303 |
| 4,944,153 | A * | 7/1990 | Goerlich et al. | 60/303 |
| 5,517,961 | A | 5/1996 | Ward | |
| 5,571,484 | A * | 11/1996 | Pettit et al. | 422/173 |
| 5,806,482 | A | 9/1998 | Igarashi et al. | |
| 6,003,487 | A | 12/1999 | Merritt | |
| 2007/0000242 | A1 * | 1/2007 | Harmon et al. | 60/295 |

FOREIGN PATENT DOCUMENTS

| | | |
|---|---|---|
| DE | 4209470 | 8/1993 |
| WO | 2008027145 | 3/2008 |

* cited by examiner

*Primary Examiner* — Thomas E Denion
*Assistant Examiner* — Audrey Klasterka
(74) *Attorney, Agent, or Firm* — Spencer J. Bonner; Finnegan, Henderson, Farabow, Garrett & Dunner LLP

(57) ABSTRACT

A regeneration device is disclosed. The regeneration device may include a housing and a perforated plate. The housing may have a passage configured to receive a flow of combustion air, and a separate bore configured to receive an electrical device. The perforated plate may be mounted to the housing to at least partially define an air chamber. Furthermore, the regeneration device may include at least one purge passageway located to communicate combustion air from the air chamber with the bore.

9 Claims, 3 Drawing Sheets

REGENERATION DEVICE PURGED WITH COMBUSTION AIR FLOW

TECHNICAL FIELD

The present disclosure is directed to a regeneration device and, more particularly, to a regeneration device that is purged with a combustion air flow.

BACKGROUND

Engines, including diesel engines, gasoline engines, gaseous fuel powered engines, and other engines known in the art exhaust a complex mixture of air pollutants. These air pollutants include solid material known as particulate matter or soot. Due to increased attention on the environment, exhaust emission standards have become more stringent and the amount of particulate matter emitted from an engine is regulated depending on the type of engine, size of engine, and/or class of engine.

One method implemented by engine manufacturers to comply with the regulation of particulate matter exhausted to the environment has been to remove the particulate matter from the exhaust flow of an engine with a device called a particulate trap. A particulate trap is a filter designed to trap particulate matter and typically consists of a wire mesh or ceramic honeycomb medium. Although the particulate trap adequately removes particulate matter from the exhaust flow of an engine, the use of the particulate trap for extended periods may cause excessive amounts of the particulate matter to build up in the medium. This buildup may reduce the functionality of the filter and subsequent engine performance.

The collected particulate matter may be removed from the filter through a process called regeneration. To initiate regeneration of the filter, the temperature of the particulate matter entrained within the filter must be elevated to a combustion threshold, at which the particulate matter is burned away. One way to elevate the temperature of the particulate matter is to inject fuel into the exhaust flow of the engine and ignite the injected fuel. Electrical devices such as a thermocouple, an igniter, a pressure sensor, or any other electrical device known in the art, may be employed to facilitate or provide feedback for the regeneration process.

After the regeneration event, the supply of fuel is shut off. However, during regeneration some fuel may spray and remain on the electrical device. This remaining fuel, when subjected to the harsh conditions of the exhaust stream may coke or be partially burned, leaving behind a solid residue that can foul the electrical devices. This fouling can cause the electrical device to send poor readings or, in the case of an igniter (e.g. a spark plug), to ground out. In addition, particulate matter and/or other debris may enter a cavity housing the electrical device from the exhaust flow, and similarly foul the electrical device. For this reason it may be necessary to periodically purge the electrical devices and the cavities in which they are housed.

One method of purging an electrical device is described in U.S. Pat. No. 6,003,487 (the '487 patent) issued to Merritt on Dec. 21, 1999. Specifically, the '487 patent discloses a spark plug housed in a cavity of a combustion engine's cylinder. The cavity is purged by "toroidal" movement of air and fuel. That is, two cylinders connected by an orifice share the same combustion space when their respective pistons are at the inner dead center positions. As the pistons reciprocate they generate the "toroidal" flow within the combustion space to provide better mixing of air with an injected fuel. The spark plug cavity is in communication with one of the two cylinders and is purged with this "toroidal" air-fuel mixture. Because the cavity is open to the common combustion space at a spark end, the "toroidal" flow of fuel-air mixture passes into the cavity and around the spark end, thus purging the spark plug.

Although the spark plug may benefit somewhat from the purging process described in the '487 patent, the effectiveness of the purging may be limited. Specifically, because the spark plug of the '487 patent is purged with a fuel-air mixture, some residual fuel may remain on the spark plug or within its cavity, even after the purging process is complete. This residual fuel, under the heat of combustion, may still coke and cause fouling. In addition, the design of the '487 patent may have limited functionality in an exhaust regeneration device that does not have any pistons to generate a specific air flow pattern.

The regeneration device of the present disclosure solves one or more of the problems set forth above.

SUMMARY OF THE DISCLOSURE

One aspect of the present disclosure is directed toward a regeneration device, which may include a housing and a perforated plate. The housing may have a passage configured to receive a flow of combustion air, and a separate bore configured to receive an electrical device. The perforated plate may be mounted to the housing to at least partially define an air chamber. Furthermore, the regeneration device may include at least one purge passageway located to communicate combustion air from the air chamber with the bore.

Another aspect of the present disclosure is directed to a method of heating an exhaust flow. The method may include providing a flow of combustion air and a supply of fuel, directing the combustion air and fuel through a housing into an exhaust flow, and igniting the combustion air and fuel. The method may further include directing a portion of the combustion air from the air chamber to the bore to purge an electrical device.

DETAILED DESCRIPTION

Figure 1:
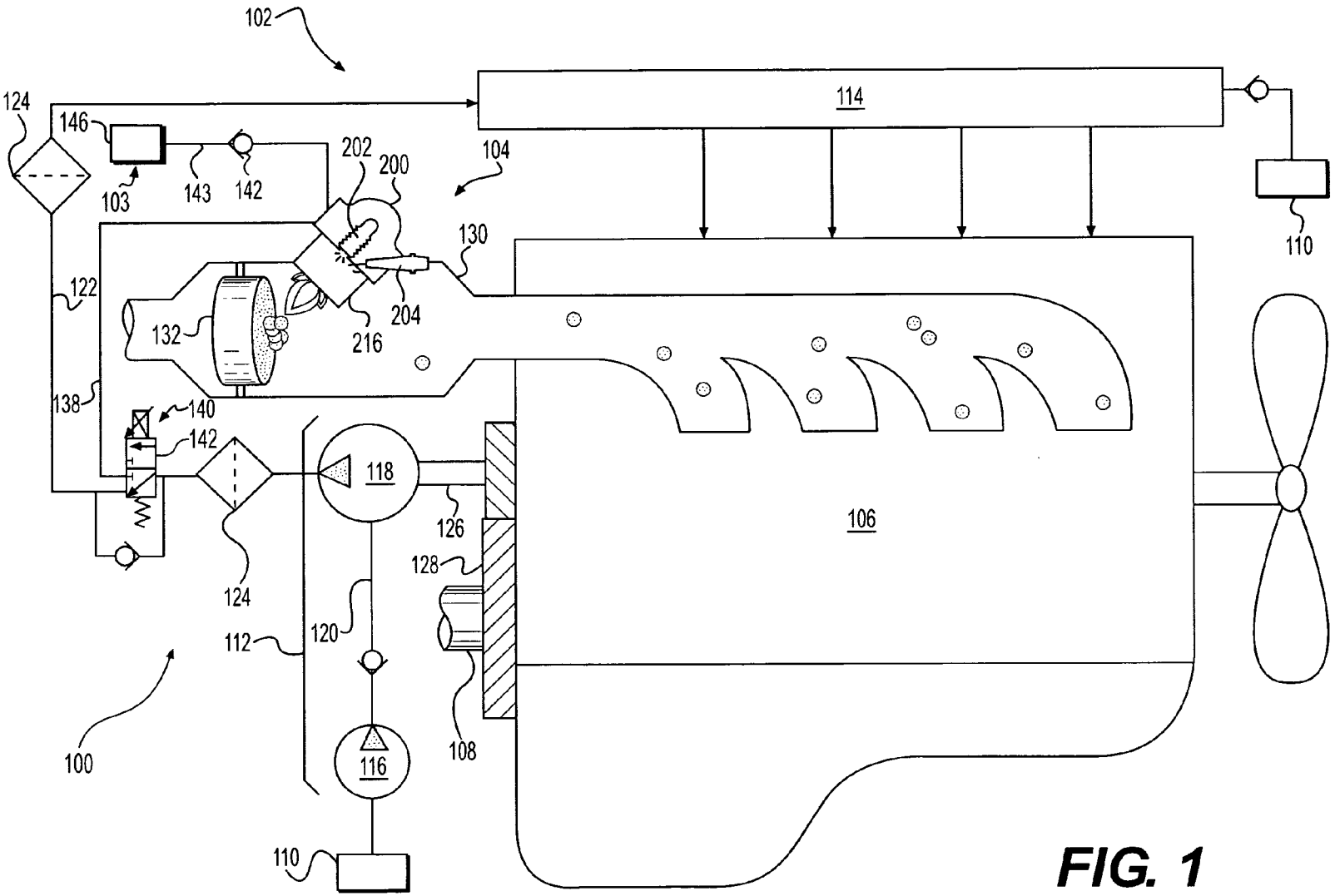
FIG. 1 is a schematic and diagrammatic illustration of an exemplary disclosed power unit.

FIG. 1 illustrates a power unit 100 having a fuel system 102 and an auxiliary regeneration system 104. For the purposes of this disclosure, power unit 100 is depicted and described as a four-stroke diesel engine. One skilled in the art will recognize, however, that power unit 100 may be any other type of internal combustion engine such as, for example, a gasoline or a gaseous fuel-powered engine. Power unit 100 may also be an external engine or a heat engine such as, for example, a sterling engine. Power unit 100 may include an engine block 106 that at least partially defines a plurality of combustion chambers (not shown). In the illustrated embodiment, power unit 100 includes four combustion chambers. However, it is contemplated that power unit 100 may include a greater or lesser number of combustion chambers and that the combustion chambers may be disposed in an "in-line" configuration, a "V" configuration, or any other suitable configuration.

As also shown in FIG. 1, power unit 100 may include a crankshaft 108 that is rotatably disposed within engine block 106. A connecting rod (not shown) may connect a plurality of pistons (not shown) to crankshaft 108 so that a sliding motion of each piston within the respective combustion chamber results in a rotation of crankshaft 108. Similarly, a rotation of crankshaft 108 may result in a sliding motion of the pistons.

Fuel system 102 may include components that cooperate to deliver injections of pressurized fuel into each of the combustion chambers. Specifically, fuel system 102 may include a tank 110 configured to hold a supply of fuel, and a fuel pumping arrangement 112 configured to pressurize the fuel and direct the pressurized fuel to a plurality of fuel injectors (not shown) by way of a manifold 114. In one embodiment, fuel system 102 may be a common rail system.

Fuel pumping arrangement 112 may include one or more pumping devices that function to increase the pressure of the fuel and direct one or more pressurized streams of fuel to manifold 114. In the common rail example, fuel pumping arrangement 112 includes a low pressure source 116 and a high pressure source 118 disposed in series and fluidly connected by way of a fuel line 120. Low pressure source 116 may embody a transfer pump that provides low pressure feed to high pressure source 118. High pressure source 118 may receive the low pressure feed and increase the pressure of the fuel up to about 300 MPa. High pressure source 118 may be connected to manifold 114 by way of a fuel line 122. One or more filtering elements 124, such as a primary filter and a secondary filter, may be disposed within fuel line 122 in series relation to remove debris and/or water from the fuel pressurized by fuel pumping arrangement 112.

One or both of low and high pressure sources 116, 118 may be operatively connected to power unit 100 and driven by crankshaft 108. Low and/or high pressure sources 116, 118 may be connected with crankshaft 108 in any manner readily apparent to one skilled in the art where a rotation of crankshaft 108 will result in a corresponding driving rotation of a pump shaft. For example, a pump driveshaft 126 of high pressure source 118 is shown in FIG. 1 as being connected to crankshaft 108 through a gear train 128. It is contemplated, however, that one or both of low and high pressure sources 116 118 may alternatively be driven electrically, hydraulically, pneumatically, or in any other appropriate manner. It is further contemplated that fuel system 102 may alternatively embody another type of fuel system such as, for example, a mechanical unit fuel injector system, where the pressure of the injected fuel is generated or enhanced within individual injectors without the use of a high pressure source.

Auxiliary regeneration system 104 may be associated with an exhaust treatment device 130. In particular, as exhaust from power unit 100 flows through exhaust treatment device 130, particulate matter may be removed from the exhaust flow by a wire mesh or ceramic honeycomb filtration media 132. Over time, the particulate matter may build up in filtration media 132 and, if left unchecked, the particulate matter buildup could be significant enough to restrict, or even block the flow of exhaust through exhaust treatment device 130, allowing for backpressure within the power unit 100 to increase. An increase in the backpressure of power unit 100 could reduce the power unit's ability to draw in fresh air, resulting in decreased performance, increased exhaust temperatures, and poor fuel consumption.

Auxiliary regeneration system 104 may include components that cooperate to periodically reduce the buildup of particulate matter within exhaust treatment device 130. These components may include, among other things, a housing 200, an injector 202, a combustion canister 216, a perforated plate 214, and an electrical device 204. Housing 200 may receive fuel to be supplied to injector 202, and combustion air to be mixed with the fuel after injection via perforated plate 214. Electrical device 204 may be housed in housing 200 to facilitate and regulate ignition and combustion of the fuel air mixture within combustion canister 216.

Figure 2:
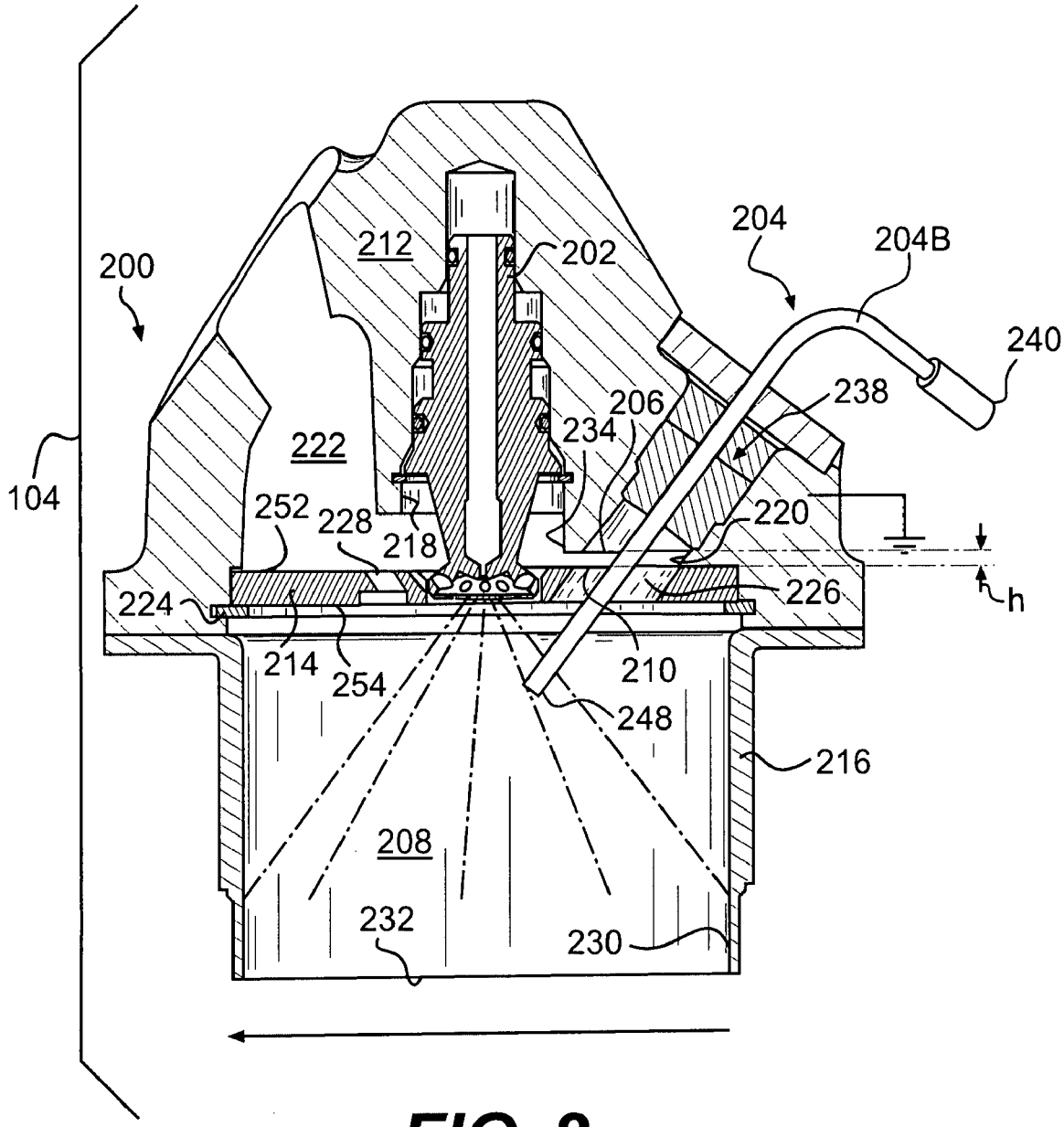
FIG. 2 is a cross-sectional illustration an exemplary disclosed regeneration device for use with the power unit of FIG. 1.

Injector 202 may be disposed within housing 200 of exhaust treatment device 130, and connected to fuel line 122 by way of a fuel passageway 138 and a main control valve 140. Injector 202 may be operable to inject an amount of pressurized fuel into combustion canister 216 at predetermined timings, fuel pressures, and fuel flow rates. The timing of fuel injection into combustion canister 216 may be synchronized with sensory input received from electrical device 204, which, in one example, may be a thermocouple 204B, as shown in FIG. 2. Alternatively, electrical device 204 could embody another sensory device such as a pressure sensor (not shown) or a timer (not shown). The timing of fuel injections may be synchronized with the sensory input such that the injections of fuel substantially correspond with a buildup of particulate matter within exhaust treatment device 130. For example, fuel may be injected as the pressure of the exhaust flowing through exhaust treatment device 130 exceeds a predetermined pressure level, or the pressure drop across filtration media 132 exceeds a predetermined differential value. Alternatively or additionally, fuel may be injected as the temperature of the exhaust flowing through exhaust treatment device 130 exceeds a predetermined value. It is contemplated that fuel may also be injected on a set periodic basis, in addition to or regardless of pressure and temperature conditions, if desired.

Figure 3:
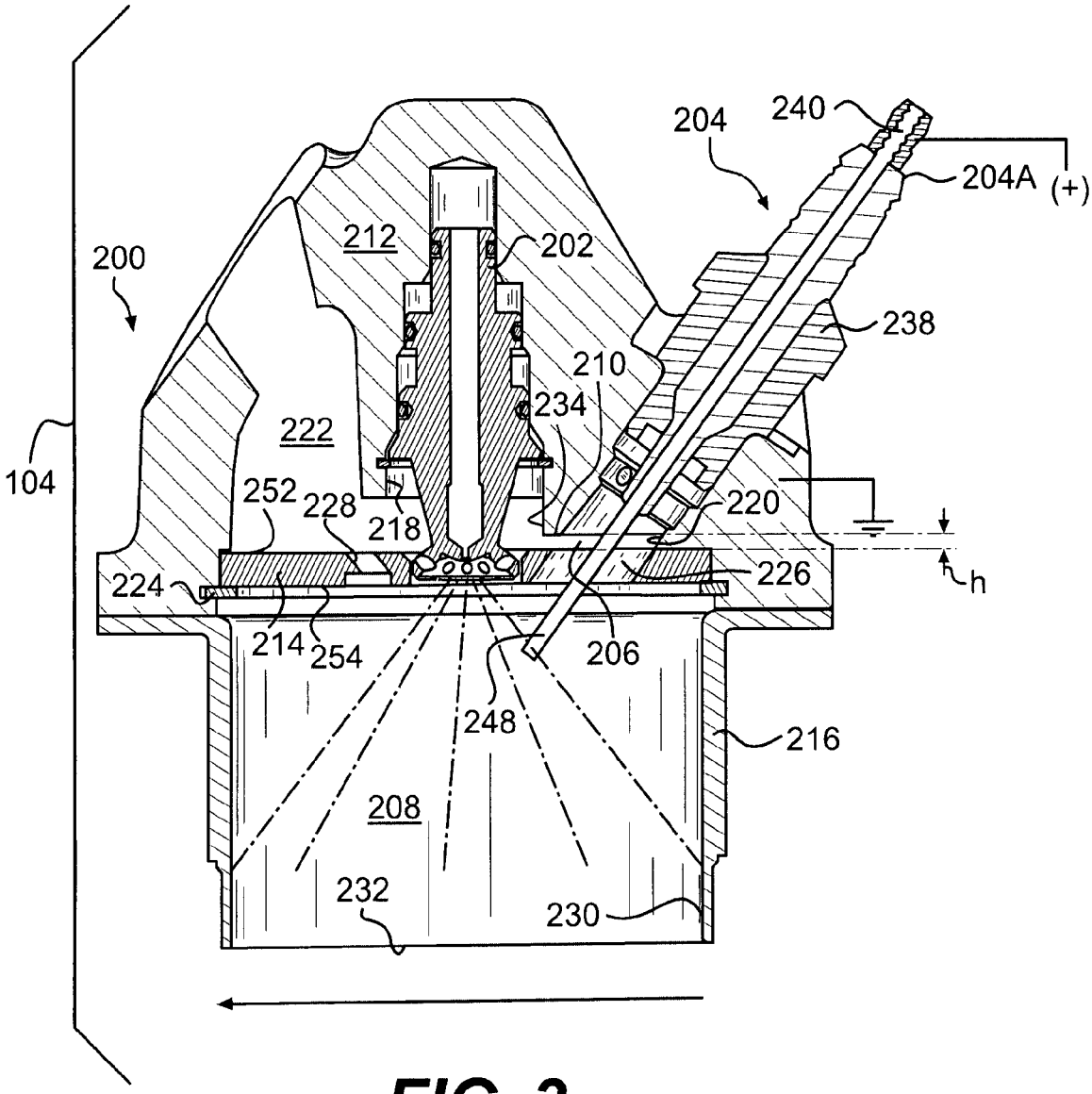
FIG. 3 is another cross-sectional illustration of the regeneration device of FIG. 2.

In another example, electrical device 204 may embody an igniter 204A, as shown in FIG. 3. It is contemplated that auxiliary regeneration system 104 may include both thermocouple 204B and igniter 204A, or any other arrangement of suitable electronic devices, if desired. Igniter 204A may facilitate ignition of fuel sprayed from injector 202 into combustion canister 216 during a regeneration event. Specifically, during a regeneration event, the temperature of the exhaust exiting power unit 100 may be too low to cause auto-ignition of the particulate matter trapped within exhaust treatment device 130 or of the fuel sprayed from injector 202. To initiate combustion of the fuel and, subsequently, the trapped particulate matter, a small quantity (i.e., a pilot shot) of fuel from injector 202 may be sprayed or otherwise injected toward an igniter 204A to create a readily-ignitable, locally-rich atmosphere. Igniter 204A may ignite the locally rich atmosphere creating a flame, which may be jetted or otherwise advanced from combustion canister 216 toward the particulate matter trapped in filtration media 132. The flame jet propagating from combustion canister 216 may raise the temperature within exhaust treatment device 130 to a level that readily supports efficient ignition of a larger quantity (i.e., a main shot) of fuel from injector 202. As the main injection of fuel ignites, the temperature within exhaust treatment device 130 may continue to rise to a level that causes ignition of the particulate matter trapped within filtration media 132, thereby regenerating exhaust treatment device 130.

Main control valve 140 may include an electronically controlled valve element 142 that is solenoid movable against a spring bias in response to a commanded flow rate. Valve element 142 may be movable from a first position, at which pressurized fuel may be directed to manifold 114, to a second position, at which fuel may be directed to auxiliary regeneration system 104. Valve element 142 may be connected to receive electronic signals indicative of which of the first and second positions is desired. It is contemplated that valve element 142 may alternatively be hydraulically or pneumatically actuated in an indirect manner, if desired. It is also contemplated that valve element 142 may be proportionally moved to any position between the first and second positions.

As illustrated in both FIGS. 2 and 3, housing 200 may include a main body 212 that receives and fluidly connects fuel injector 202 with a supply of fuel and coolant. In particular, main body 212 may be formed in or connected to an outer wall portion of exhaust treatment device 130, and include a central bore 218 for receiving fuel injector 202. Central bore 218 may be in communication with fuel system 102 to communicate fuel injector 202 with the pressurized fuel from fuel pumping arrangement 112 and/or with a heat transferring medium of an associated cooling system (not shown). Each of these systems may have passages that open into central bore 218 at different axial locations to communicate their respective fluids therewith.

Housing 200 may also include one or more radially offset bores 220 configured to house electrical device 204. Electrical device 204 may be electrically connected to a power source (not shown) or some other type of electrical relay (not shown) known in the art. Electrical device 204 may include multiple components that cooperate to perform a desired action, as described above. In particular, electrical device 204 may have a terminal end 240 connected to the power source, a body 238, and a free tip end 248 protruding into combustion chamber 208. Specifically, free tip end 248 may extend from body 238, through perforated plate 214, and into combustion chamber 208. Free tip end 248 may facilitate ignition, temperature and/or pressure sensing, or any other action known in the art to help regulate the operation of auxiliary regeneration system 104. Electrical device 204 may be threadingly received into bore 220. However, it is contemplated that other means of securing electrical device 204 to housing 200 may be employed.

Perforated plate 214 may be press-fitted into a recess of main body 212. Perforated plate 214, together with main body 212, may form an annular air chamber 222, which may be supplied with compressed air from an associated air system 103. It is contemplated that perforated plate 214 may additionally or alternatively be connected to main body 212 by way of a snap-ring 224, a threaded fastener (not shown), welding, or in any other manner known in the art, if desired.

Perforated plate 214 may include a through hole 226 and a plurality of annularly disposed air vents 228. Fuel from injector 202 may pass through a central hole of perforated plate 214 into combustion canister 216. Air vents 228 may mix air from air system 103 with the injections of fuel inside combustion canister 216. The mixing of air and fuel within combustion canister 216 may improve combustion therein. It is contemplated that air vents 228 may additionally or alternatively be directed to an outer periphery of combustion canister 216 for cooling and/or insulating purposes, if desired.

Combustion canister 216 may embody a tubular member configured to axially direct an ignited fuel/air mixture from auxiliary regeneration device 104 into the exhaust flow of exhaust treatment device 130. In particular, combustion canister 216 may include a central opening 230 that fluidly communicates fuel from fuel injector 202 and air from air chamber 222 with the exhaust flow. Combustion canister 216 may be generally straight and may have a predetermined length set during manufacture according to a desired flame introduction location (the distance that a flame resulting from the ignition of the fuel/air mixture extends from combustion canister 216 into the exhaust flow). In one example, this desired introduction location may be about 12 inches from an outlet 232 of combustion canister 216.

Air system 103 may pressurize a gas and provide this pressurized gas to auxiliary regeneration system 104 for combustion purposes. For example, a gas such as compressed air, may be directed to auxiliary regeneration system 104 to mix with fuel, thereby aiding combustion within auxiliary regeneration system 104. For this purpose, air system 103 may include a gas source 146 such as, for example, a compressor and a storage reservoir, such as a tank or an accumulator (not shown) having sufficient volume to complete a combustion process with or without operation of gas source 146. A supply line 148 may fluidly connect the components of auxiliary regeneration system 104 to gas source 146 at any upstream location. A check valve 144 may be disposed within supply line 148 to ensure that fuel and other contaminates are blocked from flowing through supply line 148 to gas source 146. The flow of combustion air through supply line 148 may be controlled by way of a suitable valve arrangement (not shown).

During, as well as in-between regeneration events, the temperature of auxiliary regeneration system's components may rise to undesired levels, causing the coking of residual fuel. As described above, the coking of residual fuel may cause the fouling of electrical device 204, and the fouling of electrical device 204 may produce poor sensory readings and/or mis-timed or failed ignitions. It is contemplated that other undesired results may also be produced by the fouling of electrical device 204. To minimize the build up of particulate matter, residual fuel, debris from the exhaust flow exiting power unit 100, and coking in general, a purging of electrical device 204 may be required.

Purging of electrical device 204 and bore 220 can be accomplished with pressurized air from air system 103 between and/or during regeneration events. Specifically, a purge passageway 210 may be in fluid communication with air chamber 222 to supply air to bore 220. That is, a space may exist between housing 200 and perforated plate 214 at a combustion end of bore 220. In one example, this space may have a height "h" of about 0.5 mm. In this manner, air supplied to air chamber 222 may also be directed to purge electrical device 204, and to positively pressurize bore 220. By pressurizing bore 220, debris from the exhaust of engine block 106 may be prevented from entering bore 220. This steady flow of air around free tip end 248 of electrical device 204 may also act as a barrier against fuel sprayed from injector 202. This barrier may further cause any fuel existing on the walls of bore 220 to evaporate before coking can occur. It is contemplated that more than one purge passageway may communicate air chamber 222 with bore 220, and/or that purge passageway 210 may be positioned in other locations, such as, completely within perforated plate 214 or within housing 200.

INDUSTRIAL APPLICABILITY

The regeneration device of the present disclosure may be used in conjunction with a variety of exhaust treatment devices including, for example, particulate traps requiring periodic regeneration, catalytic converters requiring a predetermined temperature for optimal operation, and other similar devices known in the art. In fact, the disclosed auxiliary regeneration system may be implemented into any engine system that benefits from clog-free, reliable heating. The operation of power unit 100 will now be explained.

Referring to FIG. 1, air and fuel may be drawn into the combustion chambers of power unit 100 for subsequent combustion. Specifically, fuel from fuel system 102 may be injected into the combustion chambers of power unit 100, mixed with the air therein, and combusted by power unit 100 to produce a mechanical work output and an exhaust flow of hot gases. The exhaust flow may contain a complex mixture of air pollutants composed of gaseous and solid material, which can include particulate matter. As this particulate laden exhaust flow is directed from the combustion chambers of power unit 100 through exhaust treatment device 130, particulate matter may be strained from the exhaust flow by filtration media 132. Over time, the particulate matter may build up in filtration media 132 and, if left unchecked, the buildup could be significant enough to restrict, or even block the flow of exhaust through exhaust treatment device 130. As indicated above, the restriction of exhaust flow from power unit 100 may increase the backpressure of power unit 100 and reduce the unit's ability to draw in fresh air, resulting in decreased performance of power unit 100, increased exhaust temperatures, and poor fuel consumption.

To prevent the undesired buildup of particulate matter within exhaust treatment device 130, filtration media 132 may be regenerated. Regeneration may be periodic or based on a triggering condition such as, for example, a lapsed time of engine operation, a pressure differential measured across filtration media 132, a temperature of the exhaust flowing from power unit 100, or any other condition known in the art.

To initiate regeneration, auxiliary regeneration system 104 may be caused to selectively pass fuel into exhaust treatment device 130 at a desired rate. This may be accomplished by passing fuel through housing 200 by way of fuel line 122, fuel passageway 138, and main control valve 140. From housing 200, the fuel may enter injector 202 to supply a main shot of fuel (i.e. a large shot), or a pilot shot of fuel (i.e. a small shot) followed by the main shot into combustion chamber 208. As a pilot injection of fuel from injector 202 sprays into exhaust treatment device 130, it mixes with air, and a spark from an igniter 204A may ignite the mixture. As a main injection of fuel from injector 202 is passed into exhaust treatment device 130, the burning pilot flow of fuel may ignite the main flow of fuel. The ignited main flow of fuel may then raise the temperature of the particulate matter trapped within filtration media 132 to the combustion level of the entrapped particulate matter, burning away the particulate matter and, thereby, regenerating filtration media 132.

Thermocouple 204B may help facilitate the regeneration process. Specifically, thermocouple 204B may provide feedback to help regulate timing, frequency, maximum or minimum temperatures, or any other regulatory function of exhaust treatment device 130 known in the art.

As the regeneration process takes place (and/or between regeneration events), electrical device 204 may be purged by passing combustion air from air source 146 through air chamber 222 and purge passageway 210 into bore 220. As air flows through purge passageway 210 into bore 220, it may swirl about free tip end 248 of electrical device 204. This pressurized air may purge electrical device 204 of particulate matter and any coked fuel. This pressurized flow of air may also create a barrier that surrounds free tip end 248 and minimizes the amount of fuel sprayed on free tip end 248 of electrical device 204 from injector 202. Pressurized flow of air through purge passageway 210 and bore 220 may also block the amount of debris entering bore 220 from the exhaust flow. Purging, as well as minimizing the amount of fuel and debris in contact with electrical device 204, and specifically free tip end 248, may reduce the fouling of electrical device 204. Consequently, with the fouling of electrical device 204 being reduced, filtration media 132 may be optimally and reliably regenerated, thus keeping engine performance as desired.

Because auxiliary regeneration system 104 may use only air to purge electrical device 204, likelihood of fouling caused by the purge process itself may be minimized. In addition, because source of purge air and purge passageway 210 may both be located within the auxiliary regeneration system 104, few purge lines and hoses may be needed. Thus, auxiliary regeneration system 104 may be less cluttered, providing added space and design flexibility. This may make auxiliary regeneration system 104 applicable to exhaust treatment systems where space is limited. Furthermore, due to the fewer lines and hoses needed to purge electrical device 204, auxiliary regeneration system 104 may be cheaper to produce and simpler to maintain.

It will be apparent to those skilled in the art that various modifications and variations can be made to the regeneration device of the present disclosure without departing from the scope of the disclosure. Other embodiments will be apparent to those skilled in the art from consideration of the specification and practice of the regeneration device disclosed herein. Further, although general examples have illustrated the disclosed regeneration device as being associated with the injection of fuel for particulate regeneration purposes, it is contemplated that the regeneration device may just as easily be applied to the injection of urea and/or AdBlue within a Selective Catalytic Reduction (SCR) device, if desired. It is intended that the specification and examples be considered as exemplary only, with a true scope of the disclosure being indicated by the following claims and their equivalents.

What is claimed is:

1. A regeneration device, comprising:

a housing having a passage configured to receive a flow of combustion air, and a separate bore configured to receive an electrical device;

a perforated plate mounted to the housing to at least partially define an air chamber;

a combustion chamber;

at least one purge passageway located to communicate combustion air from the air chamber to an open portion of the bore, the open portion of the bore being at least partially segregated from the combustion chamber by the perforated plate; and at least one separate passage providing fluid communication from adjacent the open portion of the bore through the perforated plate, to the combustion chamber.

2. The regeneration device of claim 1, wherein the perforated plate is configured to mix fuel with the combustion air.

3. The regeneration device of claim 1, wherein the electrical device is an igniter.

4. The regeneration device of claim 1, wherein the electrical device is a thermocouple.

5. The regeneration device of claim 1, wherein the housing further includes a central bore configured to receive an injector.

6. The regeneration device of claim 1, further including a combustion canister connected to the housing to receive combustion air and fuel, wherein the electrical device extends through the perforated plate into the combustion canister.

7. The regeneration device of claim 1, wherein the at least one purge passageway is formed by a space between the perforated plate and the housing.

8. The regeneration device of claim 7, wherein the at least one purge passageway has a height of about 0.5 mm.

9. The regeneration device of claim 8, wherein combustion air flows through the at least one purge passageway and creates a positive pressure barrier at the electrical device.

* * * * *